US007753482B2

(12) United States Patent
Ishida

(10) Patent No.: US 7,753,482 B2
(45) Date of Patent: Jul. 13, 2010

(54) PATTERN FORMING METHOD, LIQUID DROPLET DISCHARGING APPARATUS, AND ELECTROOPTICAL DEVICE

(75) Inventor: Kohei Ishida, Suwa (JP)

(73) Assignee: Seiko Epson Corporation (JP)

( * ) Notice: Subject to any disclaimer, the term of this patent is extended or adjusted under 35 U.S.C. 154(b) by 132 days.

(21) Appl. No.: 12/052,949

(22) Filed: Mar. 21, 2008

(65) Prior Publication Data

US 2008/0231658 A1 Sep. 25, 2008

(30) Foreign Application Priority Data

Mar. 22, 2007 (JP) ..... 2007-074132

(51) Int. Cl.
*B41J 2/15* (2006.01)
*B41J 2/145* (2006.01)

(52) U.S. Cl. ..... 347/40; 347/9; 347/12

(58) Field of Classification Search ..... 347/9, 347/12, 14, 15, 40, 41
See application file for complete search history.

(56) References Cited

U.S. PATENT DOCUMENTS

| | | | | |
|---|---|---|---|---|
| 5,847,721 | A * | 12/1998 | Ogata et al. | 347/9 |
| 7,165,823 | B2 * | 1/2007 | Yakura et al. | 347/12 |
| 7,216,953 | B2 | 5/2007 | Wada et al. | |
| 2007/0188533 | A1 | 8/2007 | Wada et al. | |

FOREIGN PATENT DOCUMENTS

| | | |
|---|---|---|
| JP | 2003-284992 | 10/2003 |
| JP | 2004-050445 | 2/2004 |
| JP | 2005-161681 | 6/2005 |
| JP | 2005-254210 | 9/2005 |

* cited by examiner

*Primary Examiner*—Thinh H Nguyen
(74) *Attorney, Agent, or Firm*—Harness, Dickey & Pierce, P.L.C.

(57) ABSTRACT

A pattern forming method forms a pattern on a substrate by relatively moving a plurality of nozzle groups each including a plurality of nozzles arranged in a first direction and the substrate a plurality of times in a main-scanning direction to allow the nozzles to discharge liquid droplets thereon. The method includes (i) relatively moving each nozzle group and the substrate in a sub-scanning direction such that a rear end of a former nozzle group overlaps a front end of a latter nozzle group when viewed from the main-scanning direction after every relative movement between the nozzle group and the substrate in the main-scanning direction; (ii) selecting a plurality of former nozzles among the nozzles of the former group that overlap those of the latter group to allow the selected former nozzles to discharge liquid droplets upon the relative movement between the former group and the substrate in the main-scanning direction; and (iii) selecting a plurality of latter nozzles positioned between the selected former nozzles among the nozzles of the latter group that overlap those of the former group to allow the selected latter nozzles to discharge liquid droplets upon the relative movement between the latter group and the substrate in the main-scanning direction.

11 Claims, 10 Drawing Sheets

PATTERN FORMING METHOD, LIQUID DROPLET DISCHARGING APPARATUS, AND ELECTROOPTICAL DEVICE

BACKGROUND

1. Technical Field

The present invention relates to a pattern forming method, a liquid droplet discharging apparatus, and an electrooptical device.

2. Related Art

Liquid crystal displays use an oriented film subjected to orientation treatment to determine the orientation direction of liquid crystal molecules. As a method for producing the oriented film, an inkjet method has been eagerly developed that uses a liquid droplet discharging apparatus to improve productivity and reduce production costs.

The discharging apparatus includes nozzles that discharge liquid droplets containing an oriented-film material and a discharging head with the nozzles moving relatively with respect to a substrate. The head and the substrate are relatively moved in a main-scanning direction, whereby selected nozzles discharge the liquid droplets. Then, fluid layers containing the oriented-film material are sequentially drawn in the main-scanning direction on the substrate and dried to be formed into the oriented film.

In the discharging apparatus, when the oriented film becomes larger than a scanning width of the discharging head, the head and the substrate are relatively moved in a sub-scanning direction intersecting with the main-scanning direction and then again are relatively moved in the main-scanning direction. In short, the head performs a line-feeding scanning. In the line-feeding scanning, the droplets discharged by the former scanning begin to dry faster than those discharged by the latter scanning. As a result, a part of fluid material landed on the latter scanning region is flown to a former-scanning region, thereby causing the formation of streak-like stepped portions having a thickness continuing in the main-scanning direction at the boundary between scanning routes. The stepped portions are hereinafter referred to simply as "streak variation".

Thus, regarding the inkjet method, there have conventionally been proposed techniques for eliminating the streak variation to improve thickness uniformity of the oriented film. For example, in JP-A-2003-284992, there are provided rollers apart from a substrate surface by a predetermined distance. The rollers are pressed onto the entire surface of a coating layer formed on the substrate surface, so that the rollers' physical forces correct the thickness of the coating layer.

In the above technique, however, when correcting the thickness thereof, the rollers are pressed onto the entire coating layer, whereby most of the fluid material contained in the layer adheres to the rollers and is removed from the substrate surface. Consequently, using the technique in the liquid droplet discharging apparatuses increases the using amount of the oriented-film material. This hinders raw material reduction, which is an advantage of the inkjet method.

SUMMARY

Therefore, the present invention has been accomplished to solve the problems. An advantage of the present invention is to provide a pattern forming method that makes continuous the boundary between layer patterns formed by line-feeding scanning at different timings. Another advantage of the invention is to provide a liquid droplet discharging apparatus and an electrooptical device using the method.

According to a first aspect of the invention, there is provided a pattern forming method for forming a pattern on a substrate by relatively moving a plurality of nozzle groups each including a plurality of nozzles arranged in a first direction and the substrate a plurality of times in a main-scanning direction to allow the nozzles to discharge liquid droplets thereon. The method includes (i) relatively moving each of the nozzle groups and the substrate in a sub-scanning direction such that a rear end of a former nozzle group overlaps a front end of a latter nozzle group when viewed from the main-scanning direction after every relative movement between the nozzle group and the substrate in the main-scanning direction; (ii) selecting a plurality of former nozzles among the nozzles of the former group that overlap those of the latter group to allow the selected former nozzles to discharge liquid droplets upon the relative movement between the former nozzle group and the substrate in the main-scanning direction; and (iii) selecting a plurality of latter nozzles positioned between the selected former nozzles among the nozzles of the latter group that overlap those of the former group to allow the selected latter nozzles to discharge liquid droplets upon the relative movement between the latter nozzle group and the substrate in the main-scanning direction.

In the above method, in a region where a layer pattern formed by a former scanning is connected to a layer pattern formed by a latter scanning, the layer patterns formed at the different timings can be repeated in the sub-scanning direction. This can disperse the boundary between the layer patterns formed at the different timings by line-feeding scanning, so that the layer patterns can be made entirely continuous.

In the method of the first aspect, upon the relative movement between the former nozzle group and the substrate in the main-scanning direction, the plurality of former nozzles may be selected at every predetermined interval in the first direction among the nozzles of the former group that overlap those of the latter group to allow the selected former nozzles to discharge the liquid droplets.

In the above method, in the connecting region between the layer patterns formed by the former and the latter scanning operations, the layer patterns formed at the different timings can be regularly repeated at every predetermined interval in the sub-scanning direction. Consequently, the layer patterns formed by discharging liquid droplets can be more surely made continuous.

In the method of the first aspect, upon the relative movement between the former nozzle group and the substrate in the main-scanning direction, the plurality of former nozzles may be selected among the nozzles of the former group that overlap those of the latter group to allow the selected former nozzles to discharge former droplets, whereas upon the relative movement between the latter nozzle group and the substrate in the main-scanning direction, a plurality of latter nozzles corresponding to the selected former nozzles may be selected among the nozzles of the latter group that overlap those of the former group to allow the corresponding latter nozzles to discharge latter liquid droplets between the former droplets landed in the main-scanning direction.

In the above method, in the connecting region between the layer patterns formed by the former and the latter scanning operations, the layer patterns formed at the different timings can be further repeated in the main-scanning direction. This can further disperse the boundary between the layer patterns formed at the different timings by the line-feeding scanning, so that the layer patterns can be made entirely more continuous.

In the method of the first aspect, upon the relative movement between the former nozzle group and the substrate in the main-scanning direction, the position of a former nozzle nearest to the latter nozzle group among the selected former nozzles may be displaced in the first direction.

In this manner, in the connecting region between the layer patterns formed by the former and the latter scanning operations, the boundary between the layer patterns formed at the different timings can be repeatedly laid out in a direction intersecting with the first direction and also intersecting with the main-scanning direction. Accordingly, the boundary therebetween can be further dispersed, so that the layer patterns can be made entirely continuous.

According to a second aspect of the invention, there is provided a pattern forming method for forming a pattern on a substrate by relatively moving a plurality of nozzle groups each including a plurality of nozzles arranged in a first direction and the substrate a plurality of times in a main-scanning direction to allow the nozzles to discharge liquid droplets thereon. The method includes (i) relatively moving each of the nozzle groups and the substrate in a sub-scanning direction such that a rear end of a former nozzle group overlaps a front end of a latter nozzle group when viewed from the main-scanning direction after every relative movement between the nozzle group and the substrate in the main-scanning direction; (ii) selecting a plurality of former nozzles among the nozzles of the former group that overlap those of the latter group to allow the selected former nozzles to discharge former droplets upon the relative movement between the former nozzle group and the substrate in the main-scanning direction; and (iii) selecting a plurality of latter nozzles corresponding to the selected former nozzles among the nozzles of the latter group that overlap those of the former group to allow the corresponding latter nozzles to discharge latter liquid droplets between the former droplets landed in the main-scanning direction upon the relative movement between the latter nozzle group and the substrate in the main-scanning direction.

In the method of the second aspect, in the connecting region between layer patterns formed by former and latter scanning operations, the layer patterns formed at the different timings can be repeatedly laid out in the main-scanning direction. Accordingly, the boundary between the layer patterns formed at the different timings can be dispersed, whereby the layer patterns can be made entirely continuous.

In the method of the second aspect, upon the relative movement between the former nozzle group and the substrate in the main-scanning direction, the plurality of former nozzles may be selected among the nozzles of the former group that overlap those of the latter group to allow the selected former nozzles to discharge the former droplets at predetermined intervals in the main-scanning direction.

In this manner, in the region where the layer patterns formed by the former and latter scanning are connected to each other, the layer patterns formed at the different timings can be regularly repeated at every predetermined interval in the main-scanning direction. Consequently, the layer patterns formed by discharging the droplets can be made more continuous.

In the method of the second aspect, upon the relative movement between the former nozzle group and the substrate in the main-scanning direction, a plurality of former nozzles continuing in the first direction may be selected among the nozzles of the former group that overlap those of the latter group to allow the selected former nozzles to discharge the former droplets at predetermined intervals in the main-scanning direction.

In the above method, in the connecting region between the layer patterns formed by the former and the latter scanning operations, the layer patterns formed at the different timings and continuing in the first direction can be repeatedly laid out in the main-scanning direction. Accordingly, the boundary between the layer patterns formed at the different timings can be dispersed in both of the sub-scanning direction and the main-scanning direction, whereby the layer patterns can be made entirely more continuous.

In the method of the second aspect, upon the relative movement between the former nozzle group and the substrate in the main-scanning direction, the position of a former nozzle selected as a nearest to the latter nozzle group among the former nozzles may be displaced in the first direction.

In this manner, in the connecting region between the layer patterns formed by the former and the latter scanning operations, the boundary between the layer patterns formed at the different timings can be repeatedly laid out in a direction intersecting with the first direction and also intersecting with the main-scanning direction. Thereby, the boundary therebetween can be dispersed, so that the layer patterns can be made entirely more continuous.

A liquid droplet discharging apparatus according to a third aspect of the invention includes a plurality of nozzle groups each including a plurality of nozzles arranged in a first direction; a moving unit that relatively moves each of the nozzle groups and the substrate in a main-scanning direction and a sub-scanning direction; and a controlling unit that drives the moving unit to relatively move the nozzle groups and the substrate a plurality of times in the main-scanning direction, in which each of the nozzle groups and the substrate are relatively moved in the sub-scanning direction such that a rear end of a former nozzle group overlaps a front end of a latter nozzle group when viewed from the main-scanning direction after every relative movement between the nozzle group and the substrate in the main-scanning direction, the controlling unit generating former selection data that selects a plurality of former nozzles among the nozzles of the former group that overlap those of the latter group to allow the selected former nozzles to discharge liquid droplets based on the former selection data, as well as generating latter selection data that selects a plurality of latter nozzles positioned between the selected former nozzles among the nozzles of the latter group that overlap those of the former group to allow the selected latter nozzles to discharge liquid droplets based on the latter selection data.

In the above discharging apparatus, in the region where the layer patterns formed by the former and the latter scanning operations are connected to each other, the controlling unit enables the layer patterns formed at the different patterns to be repeated in the first direction. This can disperse the boundary between the layer patterns formed at the different timings, whereby the layer patterns can be made entirely continuous.

A liquid droplet discharging apparatus according to a fourth aspect of the invention includes a plurality of nozzle groups each including a plurality of nozzles arranged in a first direction; a moving unit that relatively moves each of the nozzle groups and the substrate in a main-scanning direction and a sub-scanning direction; and a controlling unit that drives the moving unit to relatively move the nozzle groups and the substrate a plurality of times in the main-scanning direction, wherein each of the nozzle groups and the substrate are relatively moved in the sub-scanning direction such that a rear end of a former nozzle group overlaps a front end of a latter nozzle group when viewed from the main-scanning direction after every relative movement between the nozzle group and the substrate in the main-scanning direction, the controlling unit generating former selection data that selects a plurality of former nozzles among the nozzles of the former group that overlap those of the latter group to allow the selected former nozzles to discharge former liquid droplets based on the former selection data, as well as generating latter selection data that selects a plurality of latter nozzles corresponding to the selected former nozzles among the nozzles of the latter group that overlap those of the former group when the latter group is opposed to positions between the former liquid droplets to allow the selected latter nozzles to discharge latter liquid droplets between the former liquid droplets based on the latter selection data.

In the apparatus of the fourth aspect, in the connecting region between the layer patterns formed by the former and the latter scanning operations, the controlling unit enables the layer patterns formed at the different timings to be repeated in the main-scanning direction. This can disperse the boundary between the layer patterns formed at the different timings, so that the layer patterns can be made entirely continuous.

An electrooptical device according to a fifth aspect of the invention includes a substrate and an oriented film formed on a side surface thereof, in which the oriented film is formed by the liquid droplet discharging apparatus according to the third aspect.

Thereby, the electrooptical device of the fifth aspect can reduce streak variation entirely in the oriented film.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described.

First Embodiment

Figure 1:
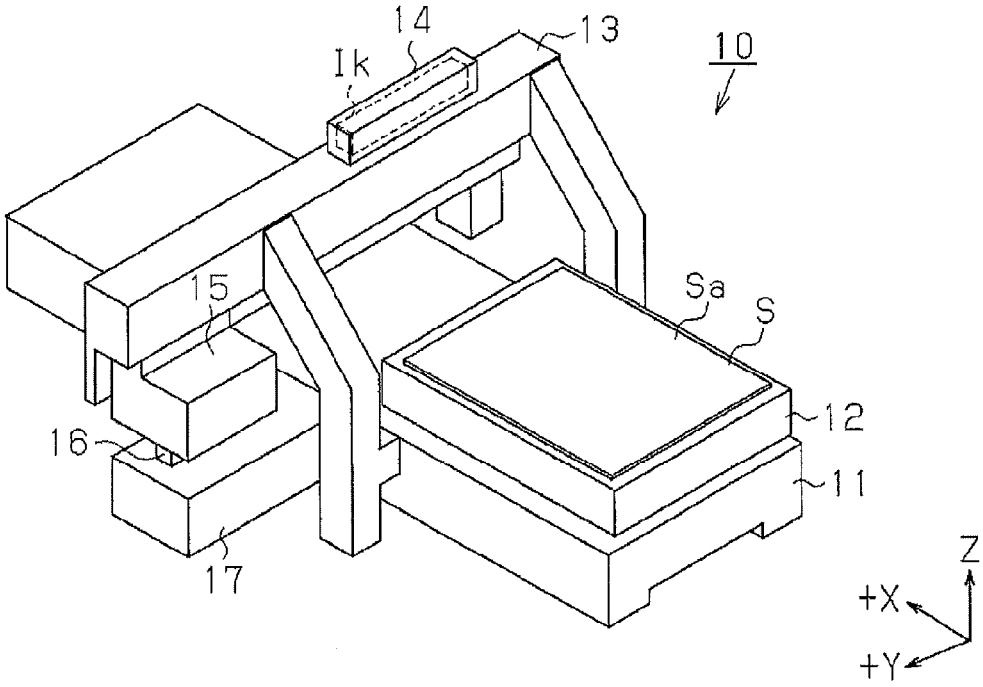
FIG. 1 is a perspective view of a liquid droplet discharging apparatus according to an embodiment of the invention.

A first embodiment of the invention will be described with reference to FIGS. 1 to 8. FIG. 1 is a perspective view of a liquid droplet discharging apparatus 10.

In FIG. 1, the liquid droplet discharging apparatus 10 includes a rectangular parallelepiped baseboard 11. On an upper surface of the baseboard 11 is disposed a stage 12 drivingly connected to an output shaft of a stage motor of the baseboard 11. The stage 12 has a substrate S mounted to be fixedly positioned thereon. When the stage motor is rotated forward or reverse, the stage 12 reciprocates in a long-axis direction of the baseboard 11 at a predetermined velocity to allow the substrate S to be scanned.

In FIG. 1, a direction from the lower right to the upper left is referred to as a +X direction (a main scanning direction), whereas a direction opposite thereto, namely, a direction from the upper left to the lower right is referred to as a −X direction. In addition, an operation of the stage 12 allowing the scanning of the substrate 12 in the +X direction is referred to as a "main scanning". The substrate S is, for example, a plate- or disk-shaped glass substrate used in a liquid crystal display or a disk-shaped silicon substrate used in a semiconductor apparatus.

Above the baseboard 11, a gate-shaped guide member 13 is bridged so as to stride thereover. An ink tank that stores ink Ik is mounted on an upper side of the guide member 13. The ink tank 14 can deliver the ink Ik as a stored liquid material at a predetermined pressure. The ink Ik may be an oriented film ink that contains a thin-film component made of an orientational polymer such as polyimide, a resist layer ink that contains a thin-film component made of a photo-sensitive resin such as novolac resin, or the like.

On a lower side of the guide member 13 is disposed a carriage 15 drivingly connected to the output shaft of a carriage motor of the guide member 13. The carriage 15 includes a plurality of discharging heads 16 provided on a lower side thereof. When the carriage motor is rotated forward or reverse, the carriage 15 reciprocates in a short-axis direction of the baseboard 11 to allow the discharging heads 16 to perform scanning.

In the scanning, a direction from the upper right to the lower left is referred to as a +Y direction (a sub-scanning direction), and a direction opposite thereto, namely, a direction from the lower left to the upper right is referred to as a −Y direction. The carriage 15 carries the discharging head 16 in the −Y direction to scan the substrate S in the +Y direction when viewed from the discharging head 16. This operation is referred to as a "sub-scanning".

On a left side of the baseboard 11 is disposed a maintenance mechanism 17. The maintenance mechanism 17 is used for cleaning or flushing of the discharging heads 16 so as to stabilize the discharging condition thereof.

Figure 2:
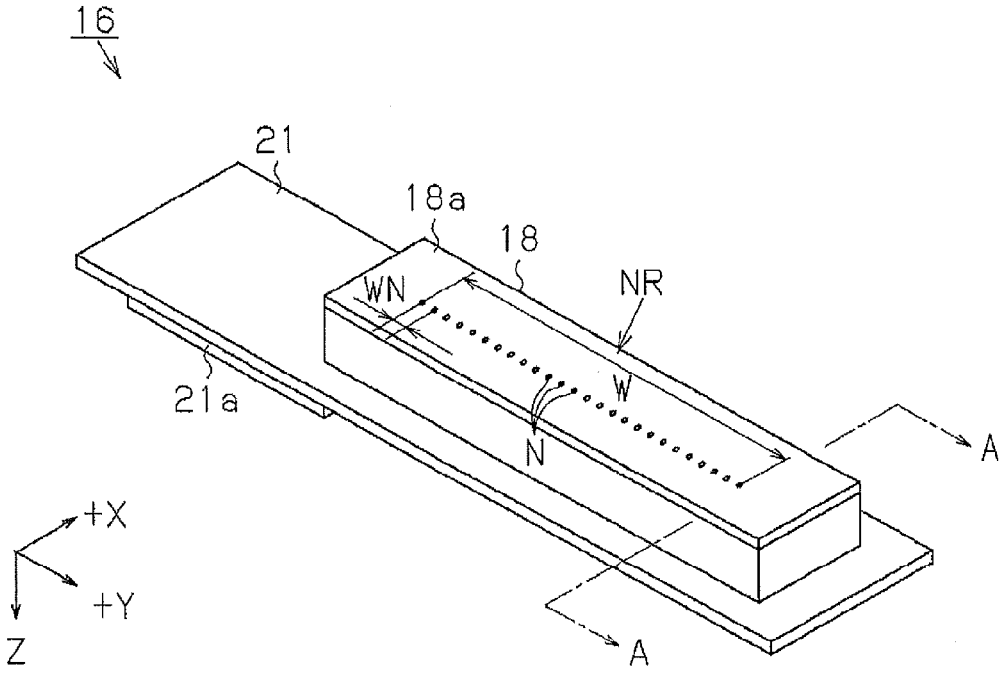
FIG. 2 is a perspective view of each of discharging heads as it appears when viewed from a substrate.
Figure 3:
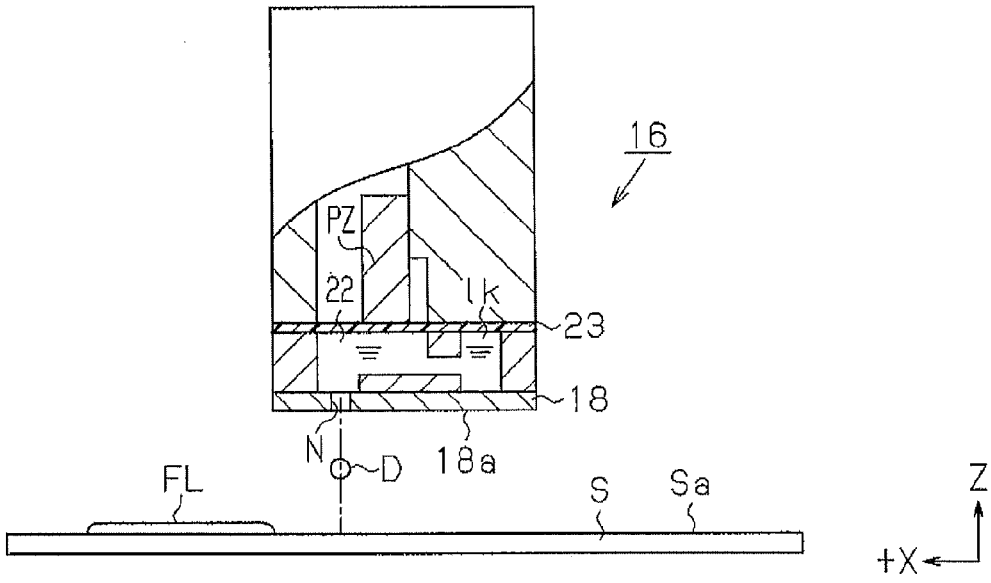
FIG. 3 is a sectional side view showing the inside of the head.
Figure 4:
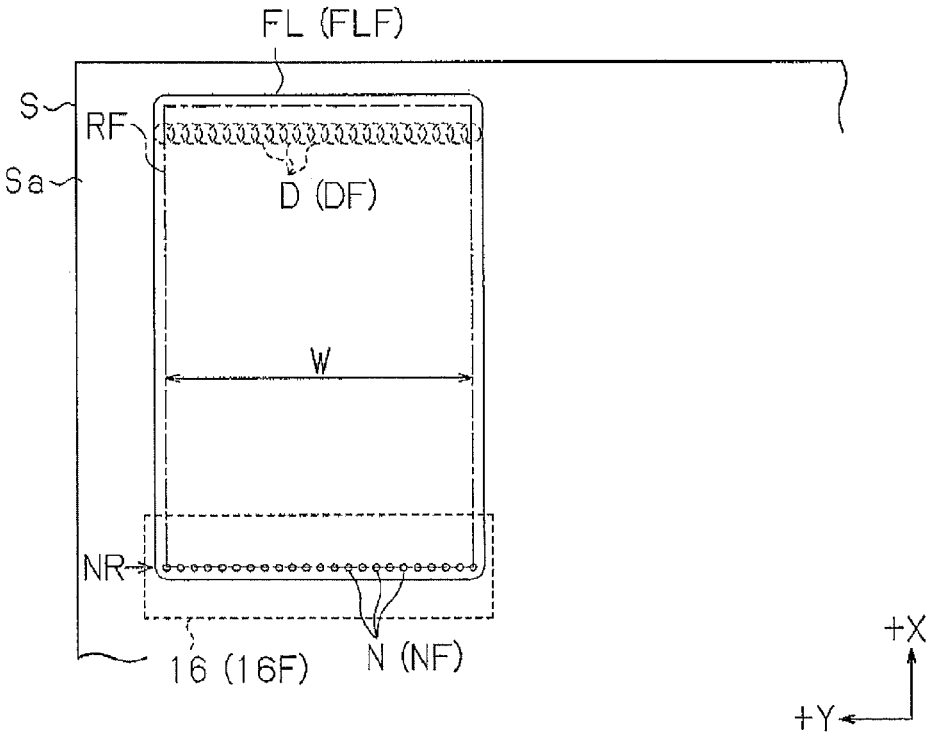
FIG. 4 is a plan view showing a scanning route of one of the heads.
Figure 5:
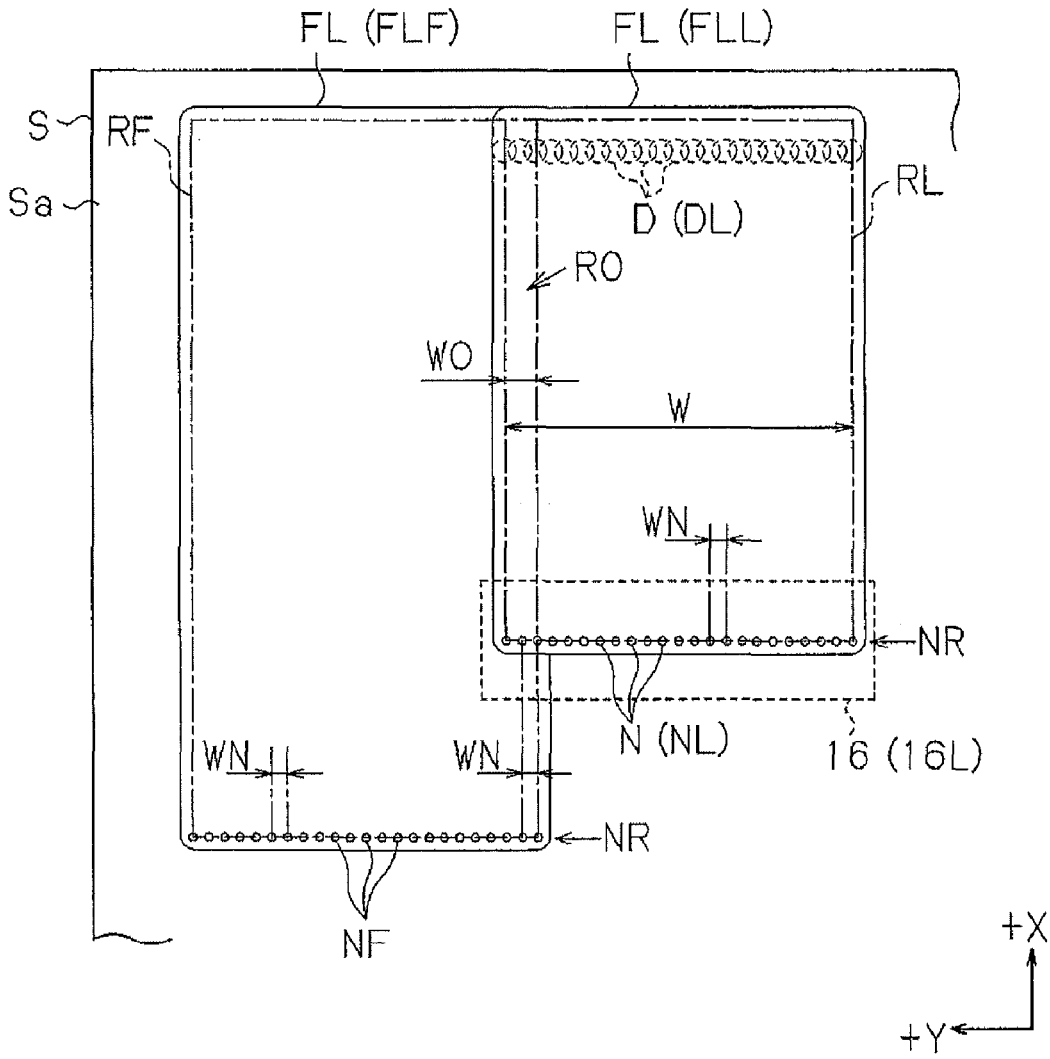
FIG. 5 is a plan view showing a scanning route of one of the heads.

FIG. 2 is a perspective view of each discharging head 16 as it appears when viewed from the stage 12. FIG. 3 is a sectional view thereof taken along a line A-A of FIG. 2. FIGS. 4 and 5 are each a schematic plan view showing a scanning route of each discharging head 16. In FIGS. 4 and 5, for convenience in the description of the scanning route thereof, the quantity of nozzles N is simplified.

In FIG. 2, a nozzle plate 18 is disposed on an upper side of the discharging head 16 (the lower side of the head in FIG. 1). On an upper surface of the nozzle plate 18 is formed a nozzle-formed surface 18*a* parallel to the substrate S. On the nozzle-formed surface 18*a* are formed 180 nozzles N penetrating through the plate in a normal direction on the surface 18*a*. The nozzles N are arranged at equal intervals in the sub-scanning direction to form a single nozzle row NR.

In this case, a width of the nozzle row NR in the sub-scanning direction is referred to as a nozzle row width W, and the formation pitch between each adjacent pair of the nozzles N is referred to as a nozzle pitch WN.

On a lower side of the discharging head 16 (an upper side of the head in FIG. 1) is disposed a head substrate 21, at an end of which is disposed an input terminal 21*a* that receives a predetermined driving waveform signal input to drive the head.

In FIG. 3, on an upper side of each nozzle N is provided a cavity 22 that communicates with each ink tank 14. The cavity 22 stores the ink Ik delivered from the ink tank 14 to supply to a nozzle N corresponding thereto. On an upper side of each cavity 22 is bonded a vibrating plate 23, which can vibrate vertically to expand or contract a capacity of the cavity corresponding thereto. On the vibrating plate 23 is disposed each piezoelectric element PZ. The piezoelectric element PZ is contracted and extended vertically to vibrate the vibrating plate 23 corresponding thereto, when the driving waveform signal is input to drive the element PZ.

The cavity 22 vibrates a meniscus of the corresponding nozzle N vertically when the corresponding vibrating plate 23 is vibrated, so as to allow the corresponding nozzle N to discharge a liquid droplet D of the ink Ik having a predetermined amount based on the input driving waveform signal. Each droplet D discharged flies toward the substrate S and lands on a surface Sa thereof, which faces the nozzles N. The landed droplets D spread wettingly on the surface Sa and coalesce into a fluid layer FL, which is drawn entirely over the surface Sa. Then, a predetermined dry process is performed to evaporate a solvent or a dispersion medium included in the fluid layer FL, resulting in formation of a thin film.

In FIG. 4, when the stage 12 performs a main scanning of the substrate S, the nozzle row NR moves relatively with respect to the substrate S to draw a belt-like scanning route (hereinafter referred to simply as "the former route RF"), which is extended in the main-scanning direction at the nozzle row width W on the surface Sa of the substrate S. In this case, the discharging head 16 drawing the former route RF is referred to as a "former discharging head 16F" and each of the nozzles N of the former head 16F is referred to as a "former nozzle NF". Additionally, the liquid droplet D discharged from each former nozzle NF is referred to as a "former droplet DF", and the fluid layer FL formed by the former discharging head 16F is referred to as a "former fluid layer FLF".

In FIG. 5, when the stage 12 performs a sub scanning of the substrate S and then again, performs the main scanning of the substrate S, namely, when it performs a line-feed scanning of the substrate S, the nozzle row NR draws a scanning route (hereinafter referred to simply as a "latter route RL") that overlaps an end portion of the former route RF in the −Y direction over an approximately entire width of the main-scanning direction. In this case, the discharging head 16 drawing the latter route RL is referred to as a "latter discharging head 16L", and each nozzle N of the latter head 16L is referred to as a "latter nozzle NL". Additionally, the liquid droplet D discharged from the latter nozzle NL is referred to as a "latter droplet DL", and the fluid layer FL formed by the latter head 16L is referred to as a "latter fluid layer FLL".

When the stage 12 performs the main-scanning and the line-feed scanning of the substrate S, the former nozzles NF and the latter nozzles NL, respectively, are arranged continuously at equal intervals when viewed from the main-scanning direction so as to equalize a resolution of the nozzles N over an entire width of the substrate S in the sub-scanning direction. In a region where the former and the latter routes RF and RL overlap each other, the former and the latter nozzles NF and NL move on the same route when viewed from the substrate S.

A width of the overlapping region of the nozzle rows NR of the former and the latter discharging heads 16F and 16L is referred to as an "overlapping width WO", and a route where the routes RF and RL mutually overlap is referred to as an "overlapping route RO". A ratio of the overlapping width WO with respect to the nozzle row width W is referred to as an "overlapping ratio". The liquid droplet discharging apparatus 10 of the embodiment has the overlapping ratio preferably ranging from 5 to 40% to reduce streak variation of the fluid layer FL. If the ratio is smaller than 5%, streak variation begins to occur between the former fluid layer FLF formed by the former nozzles NF and the latter fluid layer FLL formed by the latter nozzles NL. Conversely, the overlapping ratio larger than 40% reduces the amount of sub-scanning motion, whereby line-feeding scanning frequency is needed to be significantly increased.

Figure 6:
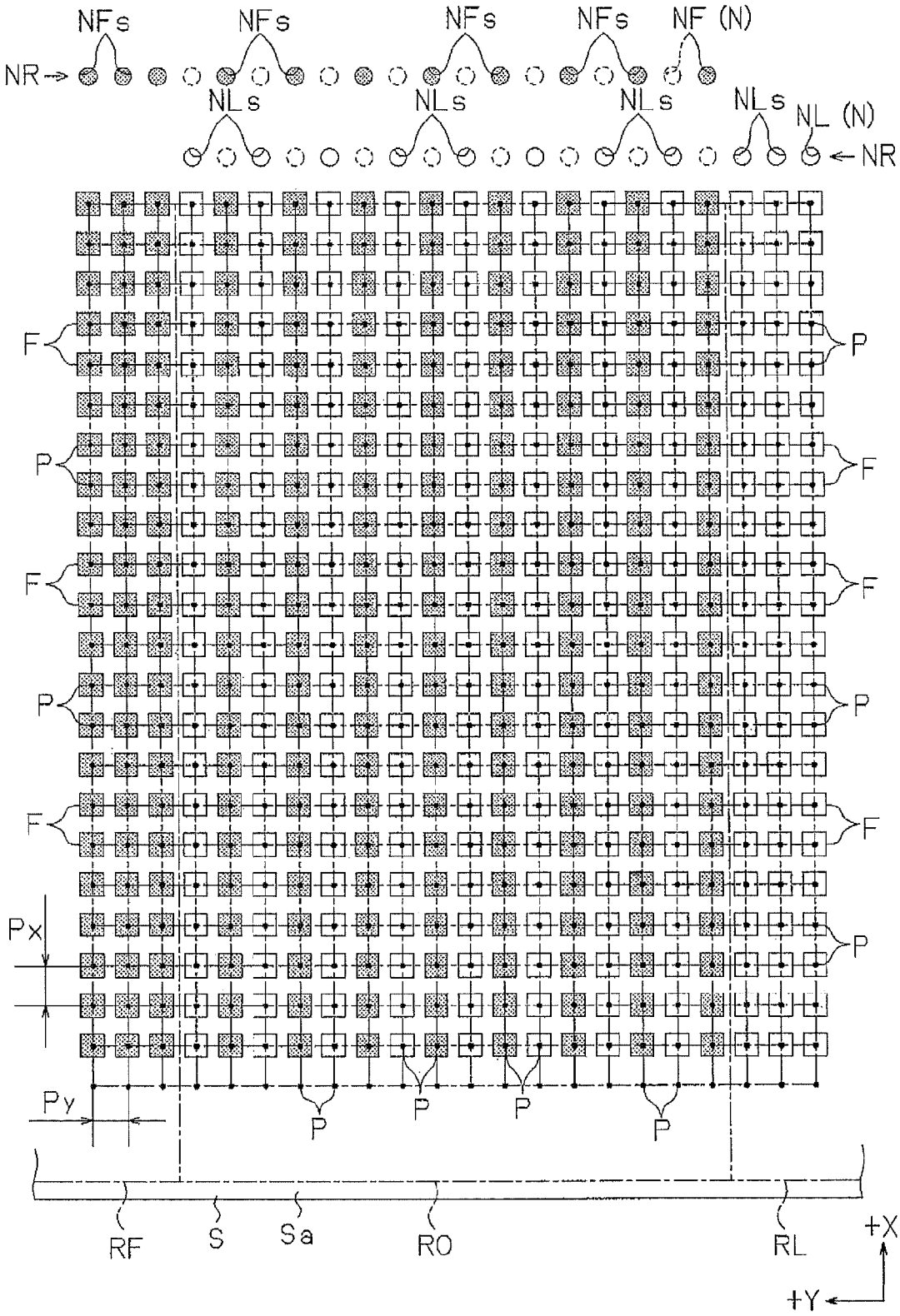
FIG. 6 is a schematic plan view showing a positional relationship between discharging positions and nozzles.

FIG. 6 is a schematic view (hereinafter referred to simply as a "dotted pattern") showing the discharging positions of the droplets D designated on the overlapping route RO and the nozzle N corresponding to each of the discharging positions.

The left and the right regions of FIG. 6, respectively, correspond to the former route RF and the latter route RL, and the center therebetween is a region corresponding to the overlapping route RO. Additionally, in FIG. 6, the nozzles N selected upon drawing are indicated by solid lines, whereas the nozzles N not selected are indicated by broken lines. The former nozzles NF selected upon drawing are marked by gradation to be referred to as "former selected nozzles NFs", whereas the latter nozzles NL selected upon drawing are shown by outlining to be referred to as "latter selected nozzles NLs".

In FIG. 6, the surface Sa of the substrate S is virtually divided into a dotted-pattern lattice indicated by single-dot chain lines. The dotted pattern lattice is defined by main-discharging pitches Px of the droplets D in the main-scanning direction and sub-discharging pitches Py of the droplets D in the sub-scanning direction. Discharging or non-discharging of the liquid droplet D is selected for each lattice point P of the dotted pattern lattice. In the present embodiment, discharging of the droplet D is selected for each lattice point P surrounded by a square frame (hereinafter referred to as simply a "discharging frame F"), whereas non-discharging thereof is selected for each lattice point P not surrounded by the frame. For example, non-discharging of the droplet D is selected for each lattice point P positioned at the endmost of the −X direction, whereas discharging thereof is selected for all the other lattice points P.

For each discharging frame F, the nozzle N passing immediately over the lattice point P corresponding thereto is selected as the nozzle N that discharges the droplet D. In the embodiment, for each discharging frame F marked by gradation, the former nozzle NF is selected as the discharging nozzle N, whereas for the outlined frame F, the latter nozzle NL is selected as the discharging nozzle N.

In other words, for each discharging frame F on the former route RF excluding the overlapping route RO, the former selected nozzle NFs is selected as the nozzle N discharging the droplet D. Additionally, for each discharging frame F on the latter route RL excluding the overlapping route RO, the latter selected nozzle NLs is selected as the discharging nozzle N.

Furthermore, for each discharging frame F on the overlapping route RO, either the former nozzle NF or the latter nozzle NL is selected as the nozzle N discharging the droplet D. Specifically, for each discharging frame F on the route RO, the former selected nozzle NFs and the latter selected nozzle NLs are alternately selected on every other line in the sub-scanning direction.

When the stage 12 performs main-scanning of the substrate S, the former discharging head 16F selects all the former nozzles NF as the former selected nozzles NFs on the former route RF excluding the overlapping route RO to allow each of the former selected nozzles NFs to discharge the former liquid droplet DF. The former droplets DF discharged on the former route RF excluding the overlapping route RO spread entirely over the corresponding route, thereby resulting in drawing of the former fluid layer FLF thereover.

The former discharging head 16F also selects every second former selected nozzle NFs among the former nozzles NF corresponding to the overlapping route RO to allow the former selected nozzles NFs to discharge the former droplets DF. The former droplets DF discharged on the overlapping route RO form a large number of the former fluid layers FLF, which are linearly extended in the main-scanning direction, at equal intervals in the sub-scanning direction.

Meanwhile, when the stage 12 performs line-feeding scanning of the substrate S, the latter discharging head 16L selects all the latter nozzles NL as the latter selected nozzles NLs to allow the latter selected nozzles NLs to discharge the latter droplets DL on the latter route RL excluding the overlapping route RO. The latter droplets DL discharged thereon draw the latter fluid layer FLL entirely over the corresponding route.

In addition, from the latter nozzles NL corresponding to the overlapping route RO, the latter discharging head 16L selects those NL not positioned on the scanning route of the former selected nozzles NFs, as the latter selected nozzles NLs, so as to allow the nozzles NLs to discharge the latter droplets DL. The latter droplets D discharged onto the overlapping route RO land on the surface Sa to fill between the former droplets DF, so as to form a large number of the latter fluid layers FLL that are linearly extended in the main-scanning direction.

Under the above situation, each of the former droplets DF is discharged at a timing faster by the time of a line feeding by the discharging head 16 than the discharging of each latter droplet DL. Accordingly, the former fluid layers FLF begin to dry faster than the latter fluid layers FLL, thereby causing the ink Ik of the latter fluid layers FLL to be flown toward the adjacent former fluid layers FLF by the amount of drying in progress. This leads to the formation of stepped portions (the streak variation) having a film thickness at the boundaries between the former and the latter fluid layers FLF and FLL. The former and latter droplets DF and DL landing on the overlapping route RO regularly disperse the streak variation to form it into a minute streak variation at every sub-discharging pitch Py, thereby drawing a uniform vertical-striped pattern entirely on the overlapping route RO. Thereby, in the fluid layer FL formed entirely on the overlapping route RO, the boundaries between the former and the latter fluid layers FLF and FLL are obscured so as to be continuous when viewed from the entire substrate S, thus reducing the streak variation therebetween.

Figure 7:
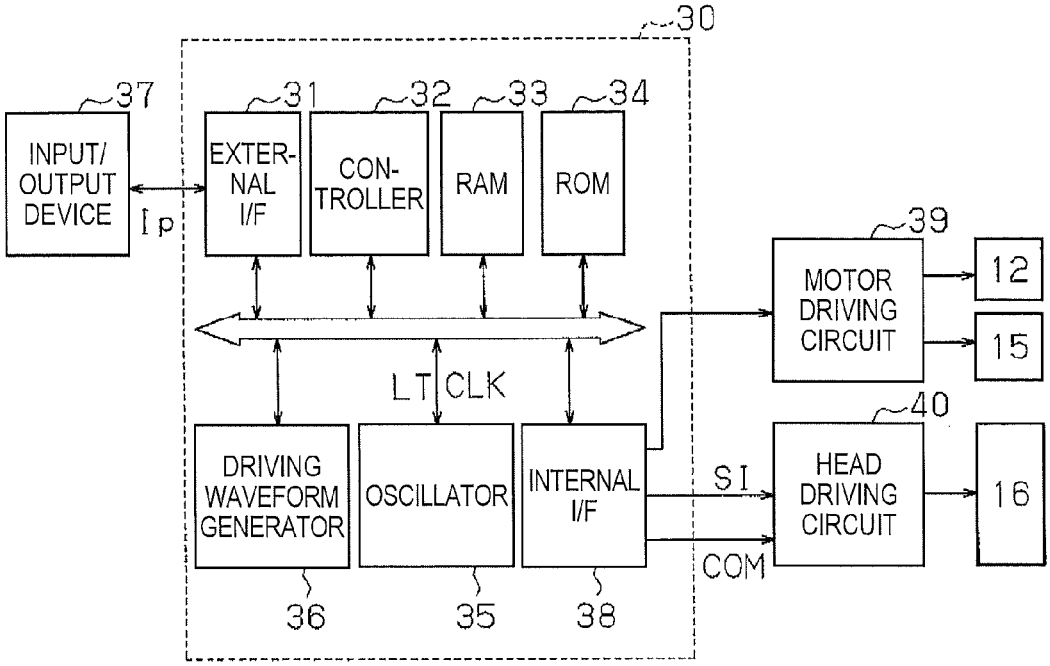
FIG. 7 is an electrical block diagram showing an electrical structure of the liquid droplet discharging apparatus.

Next, the electrical structure of the liquid droplet discharging apparatus 10 will be described with reference to FIGS. 7 and 8. FIG. 7 is a block diagram of the electrical structure thereof, and FIG. 8 is a block diagram of the electrical structure of a head driving circuit.

Figure 8:
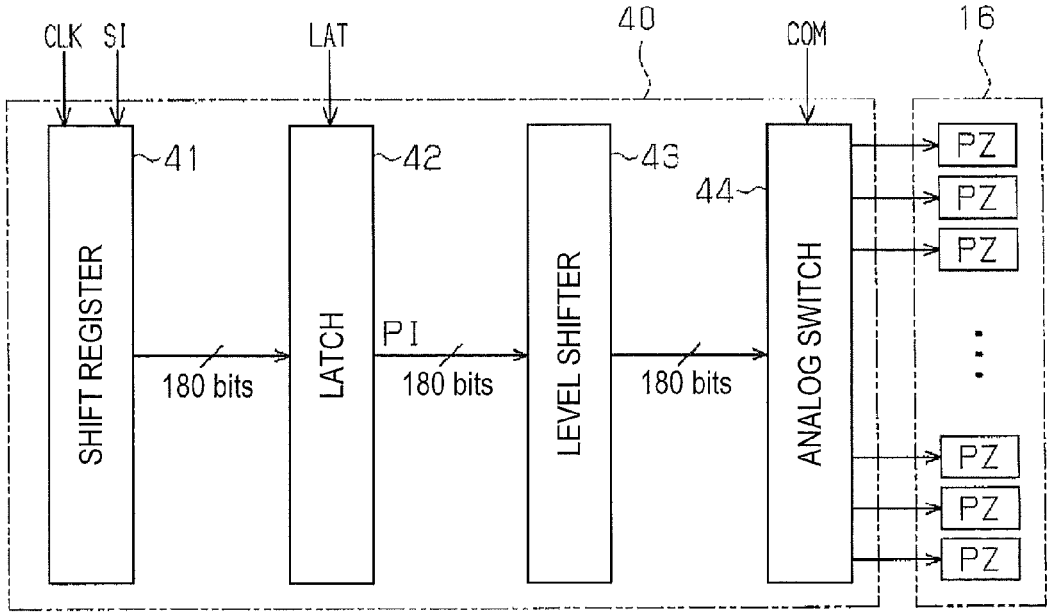
FIG. 8 is an electrical block diagram showing an electrical structure of a head driving circuit.

In FIG. 8, a controlling device 30 included in a controlling unit allows the discharging apparatus 10 to execute various processing operations. The controlling device 30 includes an external I/F 31, a controller 32 including a CPU, a RAM 33 including a DRAM and a SRAM and storing various data, and a ROM 34 storing various controlling programs. Additionally, the controlling device 30 also includes an oscillator 35 that generates a clock signal, a driving waveform generator 36 that generates a driving waveform signal driving each piezoelectric element PZ, and an internal I/F 38 transmitting various signals.

The controlling device 30 is connected to an input/output device 37 via the external I/F 31, and also via the internal I/F 38, connected to a motor driving circuit 39 that allows the stage 12 and the carriage 15 to perform scanning operation. Additionally, via the internal I/F 38, the controlling device 30 is connected to a head driving circuit 40 that drivingly controls the discharging head 16.

For example, the input/output device 37 is an external computer that includes a CPU, a RAM, a ROM, a hard disk, and a liquid crystal display. The input/output device 37 outputs various controlling signals driving the apparatus 10 according to the controlling programs stored in the ROM or the hard disk to the external I/F 31, which, in turn, receives drawing data Ip from the input/output device 37.

The drawing data Ip represents various data that discharges the liquid droplets D, such as data relating to the positions of the former and the latter routes RF and RL with respect to the surface Sa, data relating to the scanning velocity of the stage 12, and data determining whether the liquid droplet D is discharged or not on each lattice point P of the dotted-pattern lattice.

The RAM 33 is used as a receiving buffer, an intermediary buffer, and an output buffer. The ROM 34 stores various controlling routines executed by the controller 32 and various data executing the controlling routines.

The oscillator 35 generates a clock signal that synchronizes such various data and driving signals. For example, the oscillator 35 generates a transfer clock CLK used to serially transfer the various data. In every discharging cycle of the liquid droplet D, the oscillator 35 generates a latch signal LAT used to perform the parallel conversion of the data serially transferred.

The driving waveform generator 36 stores waveform data that generates various driving waveform signals COM in such a manner that the data corresponds to each predetermined address. At every clock signal of the discharging cycle, the driving waveform generator 36 latches the waveform data read by the controller 32 to covert it into an analog signal. Then, the generator amplifies the signal to generate the driving waveform signal COM.

The external I/F 31 receives the drawing data Ip from the input/output device 37. The controller 32 temporarily stores the data Ip in the RAM 33 to convert it into an intermediate code. The controller 32 reads the stored intermediate code data from the RAM 33 to generate dotted pattern data. The dotted pattern data relates the discharging or non-discharging of the liquid droplet D to each lattice point P of the dotted pattern lattice.

The controller 32 generates dotted pattern data equivalent to the amount of a single main scanning or a single line-feeding scanning and uses the data to generate serial data in synch with the transfer clock CLK. Thereafter, the controller 32 serially transfers the serial data to the head driving circuit 40 via the internal I/F 38.

The serial data generated using the dotted patter data is referred to as "serial pattern data SI". The serial pattern data SI has a bit value that determines the discharging or non-discharging of the droplet D, which is equivalent to the quantity of the nozzles N, namely, 180. The data SI is generated sequentially at every discharging cycle.

The controller 32 is connected to the motor driving circuit 39 via the internal I/F 38 to output a corresponding drive control signal to the motor driving circuit 39. In response to the signal from the controller 32, the motor driving circuit 39 moves the stage 12 and the carriage 15 via the internal I/F 38. Specifically, in response to the drive control signal for main scanning from the controller 32, the motor driving circuit 39 allows the substrate S to be scanned, and also allows the line-feeding scanning of the substrate S in response to the drive control signal for line-feeding scanning from the controller 32.

Next, the head driving circuit 40 will be described below. In FIG. 8, the head driving circuit 40 includes a shift register 41, a latch 42, a level shifter 43, and an analog switch 44.

When the controlling device 30 serially transfers the serial pattern data SI, the shift register 41 sequentially shifts the data SI by the transfer clock CLK to store the serial pattern data SI of 180 bits. When the controlling device 30 inputs the latch signal LAT, the latch 42 latches the serial pattern data SI stored in the shift register 41 to perform a serial-parallel conversion of the data so as to output it as parallel pattern data PI to the level shifter 43.

When the latch 42 outputs the parallel pattern data PI to the level shifter 43, the level shifter 43 boosts the voltage level of the data PI up to a drive voltage level of an analog switching element to generate 180 open/close signals corresponding to each of the piezoelectric elements PZ.

The analog switch 44 has 180 switching elements corresponding to each piezoelectric element PZ. Each switching element opens or closes in response to each of the open/close signals output by the level shifter 43. The driving waveform signal COM from the controlling device 30 is inputted to an input terminal of each switching element. An output terminal of the switching element is connected to the piezoelectric element PZ corresponding thereto. When the level shifter 43 outputs a high-level open/close signal, the switching element outputs the driving waveform signal COM to the corresponding piezoelectric element PZ. Conversely, when the open/close signal output is at a low level, the switching elements stop output of the driving waveform signal COM. Thereby, the controlling device 30 allows discharging of the droplets D in accordance with the dotted pattern data.

Specifically, the controlling device 30 allows the stage 12 to perform the main scanning of the substrate S, whereby each former nozzle NF passed over each lattice point P of the former route RF. During the time, the controlling device 30 allows all the former nozzles NF to be selected as the former selected nozzles NFs on the former route RF excluding the overlapping route RO, and allows the selection of every second former selected nozzle NFs among the former nozzles NF on the overlapping route RO. Next, the controlling device 30 supplies the driving waveform signal COM to the piezoelectric element PZ corresponding to each of the former selected nozzles NFs, thereby causing the former selected nozzles NFs to discharge the former droplets DF onto the respective corresponding lattice points P. Thereby, the controlling device 30 allows the former fluid layer FLF to be drawn entirely over the former route RF excluding the overlapping route RO. Meanwhile, on the overlapping route RO, the device allows the large number of the former fluid layers FLF to be drawn at equal intervals in such a manner that the layers are linearly extended over the approximately entire width of the route in the main scanning direction.

Additionally, the controlling device 30 allows the stage 12 to perform the line-feeding scanning of the substrate S, whereby each latter nozzle NL passes over each lattice point P of the latter route RL. During the time, the controlling device 30 allows all the latter nozzles NL to be selected as the latter selected nozzles NLs on the latter route RL excluding the overlapping route RO, whereas on the overlapping route RO, it allows the latter nozzles NL not positioned on the scanning route of the former selected nozzles NFs to be selected as the latter selected nozzles NLs. Then, the controlling device 30 supplies the driving waveform signal COM to the piezoelectric element PZ corresponding to each latter selected nozzle NLs, thereby causing the latter selected nozzles NLs to discharge the latter droplets DL onto the respective corresponding lattice points P. As a result, the latter fluid layer FLL is drawn entirely over the latter route RL excluding the overlapping route RO. Meanwhile, on the overlapping route RO, the large number of the linear latter fluid layers FLL is drawn so as to be extended over the approximately entire width of the route in the main scanning direction.

Next will be described a thin-film forming method using the liquid droplet discharging apparatus 10.

First, as shown in FIG. 1, the substrate S with the surface Sa upward is mounted on the stage 12. The substrate S on the stage 12 is positioned in the −X direction of the carriage 15. In this state, the input/output device 37 inputs the drawing data Ip to the controlling device 30.

The controlling device 30 performs the sub-scanning of the carriage 15 via the motor driving circuit 39 to locate the carriage 15 such that the discharging head 16 passes over the former route RF upon main scanning of the substrate S. Then, the controlling device 30 allows the motor driving circuit 39 to start the main scanning of the substrate S.

The controlling device 30 develops the drawing data Ip input from the input/output device 37 into dotted pattern data. In this case, the controlling device 30 generates the dotted pattern data as former selection data that allows all the former nozzles NF to be selected as the former selected nozzles NFs for each lattice point P on the former route RF excluding the overlapping route RO, as well as that allows every second former selected nozzle NFs among the former nozzles NF to be selected for each lattice point P on the overlapping route RO.

The controlling device 30 develops the dotted pattern data equivalent to a single main scanning and uses the data to generate serial pattern data SI. Then, the data SI is synchronized with the transfer clock CLK to be serially transferred to the head driving circuit 40.

Next, every time each lattice point P reaches immediately below the former nozzle NF, the controlling device 30 performs the serial/parallel conversion of the data SI via the head driving circuit 40 to generate the open/close signal that opens or closes each switching element. Additionally, every time each lattice point P reaches immediately therebelow, the controlling device 30 outputs the latch signal LAT and the driving waveform signal COM in synch with the signal LAT.

As described above, on the former route RF excluding the overlapping route RO, the controlling device 30 allows all the former nozzles NF to be selected as the former selected nozzles NFs, thereby causing the former selected nozzles NFs to discharge the former droplets DF in every discharging cycle. In this manner, the controlling device 30 enables the former fluid layer FLF to be drawn over the entire former route RF excluding the overlapping route. Additionally, the controlling device 30 allows every second former selected nozzle NFs among the former nozzles NF to be selected on the overlapping route RO, thereby causing the former selected nozzles NFs to discharge the former droplets DF in every discharging cycle. In this manner, on the overlapping route RO, the large number of the former fluid layers FLF is drawn at equal intervals in such a manner that they are linearly extended over the approximately entire width of the route in the main scanning direction.

Next, the controlling device 30 develops dotted pattern data as latter selected data equivalent to a single line-feeding scanning and uses the data to generate the serial pattern data SI. Then, it allows the data SI to be synchronized with the transfer clock CLK to serially transfer it to the head driving circuit 40.

Then, every time each lattice point P reaches immediately below the latter nozzle NL, the controlling device 30 performs the serial/parallel conversion of the data SI via the head driving circuit 40 to generate an open/close signal that opens or closes each switching element. Additionally, every time each lattice point P reaches immediately therebelow, the controlling device 30 outputs the latch signal LAT and the driving waveform signal COM in synch with the signal LAT.

As described above, on the latter route RL excluding the overlapping route RO, the controlling device 30 allows all the latter nozzles NL to be selected as the latter selected nozzles NLs, thereby causing the latter selected nozzles NLs to discharge the latter droplets DL in every discharging cycle. In this manner, the latter fluid layer FLL is drawn over the entire latter route RL excluding the overlapping route RO. Additionally, on the overlapping route RO, the controlling device 30 allows the latter nozzles NL not positioned on the scanning route of the former selected nozzles NFs to be selected as the latter selected nozzles NLs, thereby causing the latter selected nozzles NLs to discharge the latter droplets DL in every discharging cycle. In this manner, it allows the large number of the former fluid layers FLF to be drawn linearly at equal intervals on the overlapping route RO so as to be extended over the entire width of the route in the main scanning direction, causing the latter droplets DL to be supplied between the former fluid layers FLF.

Thereby, the controlling device 30 can add a minute streak variation to the fluid layer FL on the overlapping route RO in every sub-discharging pitch Py, so that the streak variation between the former and the latter fluid layers FLF and FLL can be reduced over the entire fluid layer FL. Thus, a predetermined dry process is performed on the fluid layer FL to evaporate a solvent or a dispersion medium thereof, thereby forming a thin film having a uniform thickness.

The first embodiment provides advantageous effects as follows:

1. In the embodiment, the main scanning of the former discharging head 16F allows the former nozzles NF to draw the former route RF, whereas the line-feeding scanning of the latter discharging head 16L allows the latter nozzles NL to draw the latter route RL. On the overlapping route RO where the both routes RF and RL mutually overlap, the former discharging head 16F selects the plural former selected nozzles NFs from the former nozzles NF to discharge the former droplets DF. Meanwhile, as the latter selected nozzles NLs, the latter discharging head 16L selects the latter nozzles NL not positioned on the scanning route of the former selected nozzles NFs, so as to allow the nozzles to discharge the latter droplets DL.

Accordingly, on the overlapping route RO formed upon every line-feeding scanning, the former fluid layer FLF by the former scanning and the latter fluid layer FLL by the latter scanning can be repeatedly formed in the sub-scanning direction. As a result, the boundary between the fluid layers FL formed at different timings can be dispersed on the overlapping routes RO and the fluid layers as a whole can be continuously formed. Consequently, a thin film made of the fluid layers FL can be formed with a more uniform thickness.

2. In the embodiment, the former discharging head 16F selects every second former selected nozzles NFs among the former nozzles NF to discharge the former droplets DF. Accordingly, on the overlapping route RO formed upon every line-feeding scanning, drawing of the former fluid layer FLF formed by the former scanning and the latter fluid layer FLL formed by the latter scanning can be regularly repeated in every sub-discharging pitch Py in the sub-scanning direction. As a result, the fluid layers FL can be more surely and continuously formed, thereby improving the thickness uniformity of a thin film made of the fluid layers FL.

Second Embodiment

Hereinafter, a second embodiment of the invention will be described with reference to FIG. 9. The second embodiment adds changes to the dotted pattern of the first embodiment. The changes will be explained in detail below.

Figure 9:
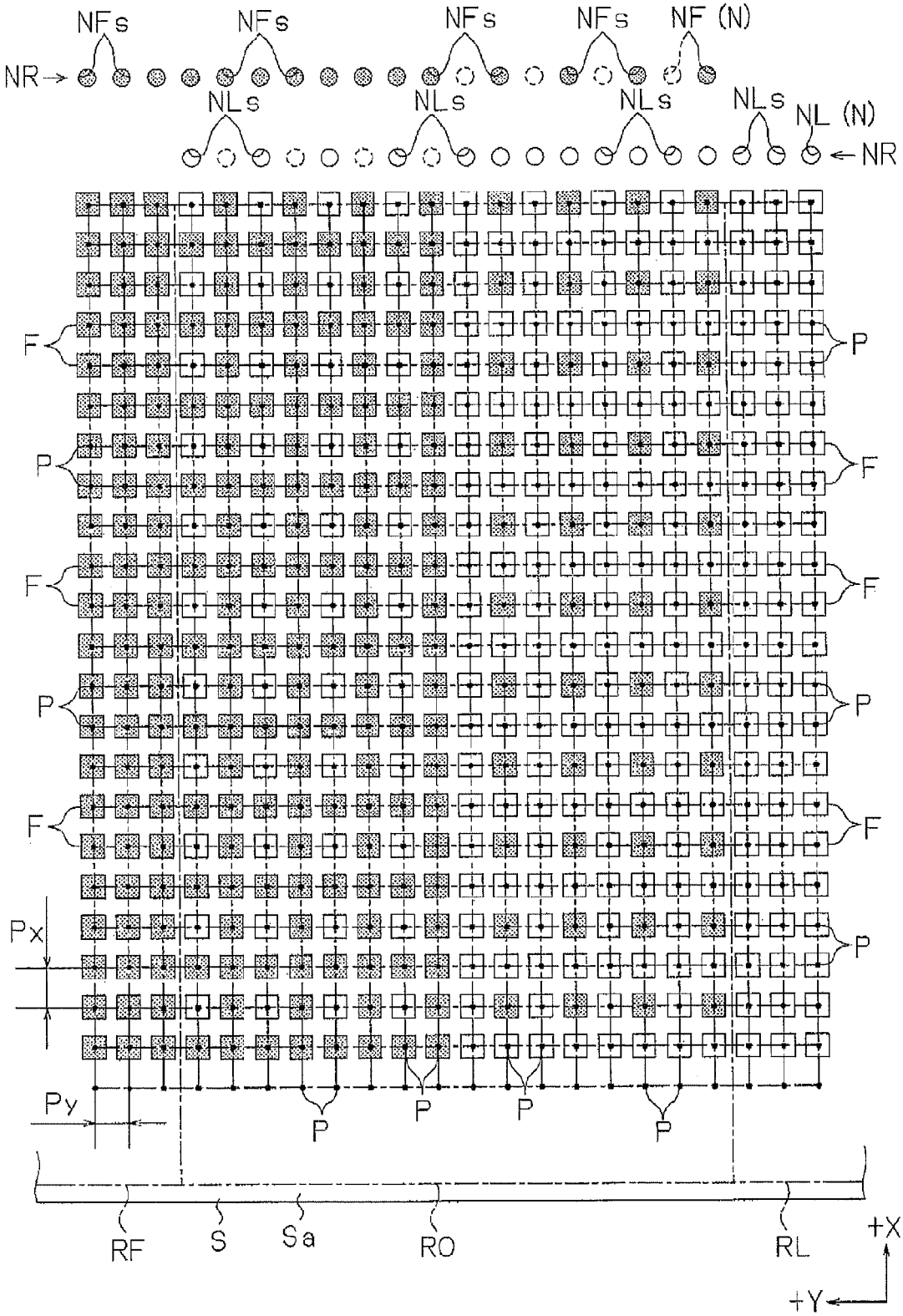
FIG. 9 is a schematic plan view showing a positional relationship between discharging positions and nozzles in the apparatus according to a second embodiment of the invention.

FIG. 9 is a plan view of a dotted pattern according to the second embodiment. As in the pattern of FIG. 6, the left region and the right region of FIG. 9, respectively, correspond to the former route RF and the latter route RL, respectively, and the center region therebetween corresponds to the overlapping route RO. Among the nozzles N passing over each of the routes RF, RL, and RO, the nozzles N selected to draw the fluid layer FL are indicated by solid lines, whereas those N not selected are indicated by broken lines. Additionally, the former nozzles NF selected for the drawing are marked by gradation to be referred to as the former selected nozzles NFs, and the latter nozzles NL selected therefor are shown by outlining to be referred to as the latter selected nozzles NLs. Furthermore, each lattice point P surrounded by the discharging frame F represents the point where the discharging of the droplet D is selected.

In FIG. 9, for each discharging frame F, the nozzle N passing immediately over the lattice point P corresponding thereto is selected to discharge the droplet D. In the present embodiment, for the discharging frames F marked by gradation, the former nozzles NF are selected as the nozzles discharging the droplets D, whereas for the outlined discharging frames F, the latter nozzles NF are selected as the discharging nozzles.

In short, for the discharging frames F on the overlapping route RO, either the former nozzles NF or the latter nozzles NL are selected as the nozzles N discharging the droplets D. Specifically, regarding the discharging frames F on the left side of the overlapping route RO, lines where the former selected nozzles NFs are selected continuously in the main scanning direction and lines where those NFs are selected alternately in the main scanning direction are arranged alternately in the sub-scanning direction. Meanwhile, regarding the discharging frames F on the right side thereof, lines having the latter selected nozzles NLs selected continuously in the main scanning direction and lines having those NLs selected alternately in the main-scanning direction are arranged alternately in the sub-scanning direction.

The controlling device 30 generates dotted pattern data corresponding to the dotted pattern shown in FIG. 9 and the serial pattern data SI corresponding to the pattern data generated, thereby allows the head driving circuit 40 to selectively discharge the former and the latter droplets. Then, the controlling device 30 allows a block check pattern (a checkered pattern) of the latter droplets DL to be drawn on a base of the former droplets DF on the left side of the overlapping route RO and allows a block check pattern of the former droplets DF to be drawn on a base of the latter droplets DL on the right side thereof.

In the above formation, the block check pattern of the latter droplets DL with the base of the former droplets DF thereon can be drawn continuously from the former route RF, as well as the block check pattern of the former droplets DF with the base of the latter droplets DL thereon can be drawn continuously from the latter route RL. Then, both the block check patterns can be connected to each other at the approximately center of the overlapping route RO in the sub-scanning direction.

Accordingly, the fluid layer FL drawn on the overlapping route RO makes a minute streak variation in the main-scanning direction and the sub-scanning direction at the boundary between the former and the latter fluid layers FLF and FLL. Consequently, the boundary therebetween can be made more continuous.

Third Embodiment

A third embodiment of the invention will be described with reference to FIG. 10. The third embodiment adds changes to the dotted pattern of the first embodiment. The changes will be described in detail below.

Figure 10:
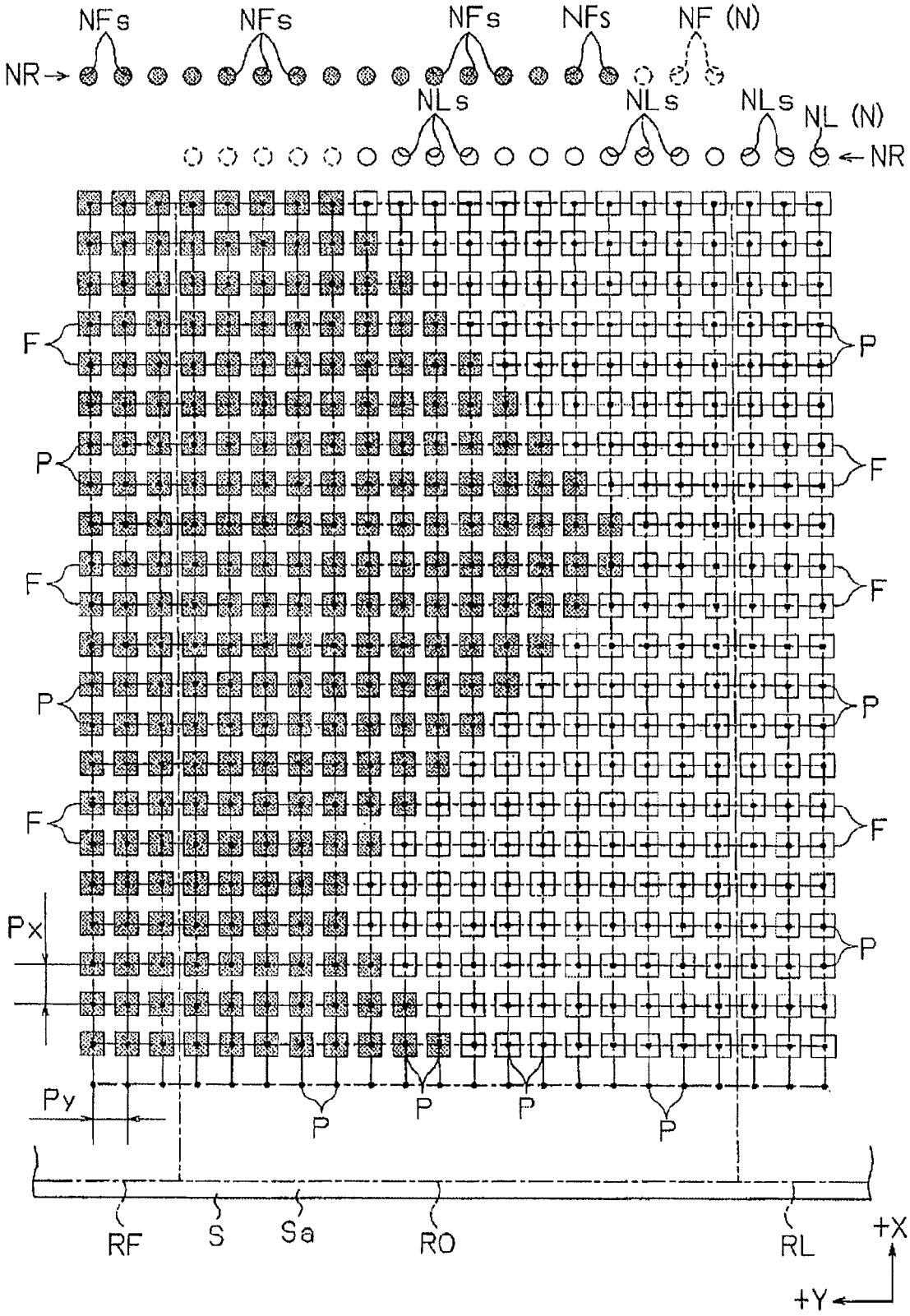
FIG. 10 is a schematic plan view showing a positional relationship between discharging positions and nozzles in the apparatus according to a third embodiment of the invention.

FIG. 10 shows a dotted pattern of the third embodiment. As in the pattern of FIG. 6, the left region and the right region of FIG. 10, respectively, correspond to the former route RF and the latter route RL, respectively, and the center region therebetween corresponds to the overlapping route RO. Among the nozzles N passing over each of the routes RF, RL, and RO, the nozzles N selected to draw the fluid layer FL are indicated by solid lines, whereas the nozzles N not selected are indicated by broken lines. Additionally, the former nozzles NF selected for the drawing are marked by gradation to be referred to as the former selected nozzles NFs, and the latter nozzles NL selected therefor are shown by outlining to be referred to as the latter selected nozzles NLs. Furthermore, each lattice point P surrounded by the discharging frame F represents the point where the discharging of the droplet D is selected.

In FIG. 10, for each discharging frame F, the nozzle N passing immediately over the lattice point P corresponding thereto is selected as the nozzle N discharging the droplet D. In the present embodiment, in order to discharge the droplet D, the former nozzles NF are selected for the discharging frames F marked by gradation, whereas the latter nozzles NL are selected for the outlined frames F.

In short, for each of the discharging frames F on the overlapping route RO, either the former nozzle NF or the latter nozzle NL is selected as the nozzle N discharging the droplet D. Specifically, for the discharging frames F on the left side of the overlapping route RO, the former selected nozzles NLs are selected continuously in the sub-scanning direction. Additionally, for the discharging frames F on the right side thereof, the latter selected nozzles NLs are selected continuously in the sub-scanning direction. Furthermore, the boundary between the frames F of the former selected nozzles NFs and the frames F of the latter selected nozzles NLs is displaced periodically by the sub-discharging pitch Py at every main-discharging pitch Px, thereby drawing a saw-toothed path continuing in the main-scanning direction.

The controlling device 30 generates dotted patter data corresponding to the dotted pattern shown in FIG. 10 and the serial pattern data SI corresponding to the generated pattern data to allow the head driving circuit 40 to selectively discharge the former and latter selected droplets DF and DL. Then, the controlling device 30 allows the boundary between the former droplets DF discharged on the left of the overlapping route RO and the latter droplets DL discharged on the right thereof to be drawn in the saw-toothed shape continuing in the main-scanning direction.

In the above formation, the fluid layer FL formed on the overlapping route RO enables the boundary between the fluid layers FLF and FLL to be formed by the saw-toothed minute streak variation in the main-scanning direction, namely, a minute streak variation in a direction intersecting with the main-scanning direction and also the sub-scanning direction. Consequently, the boundary therebetween can be made more continuous.

Fourth Embodiment

Figure 11:
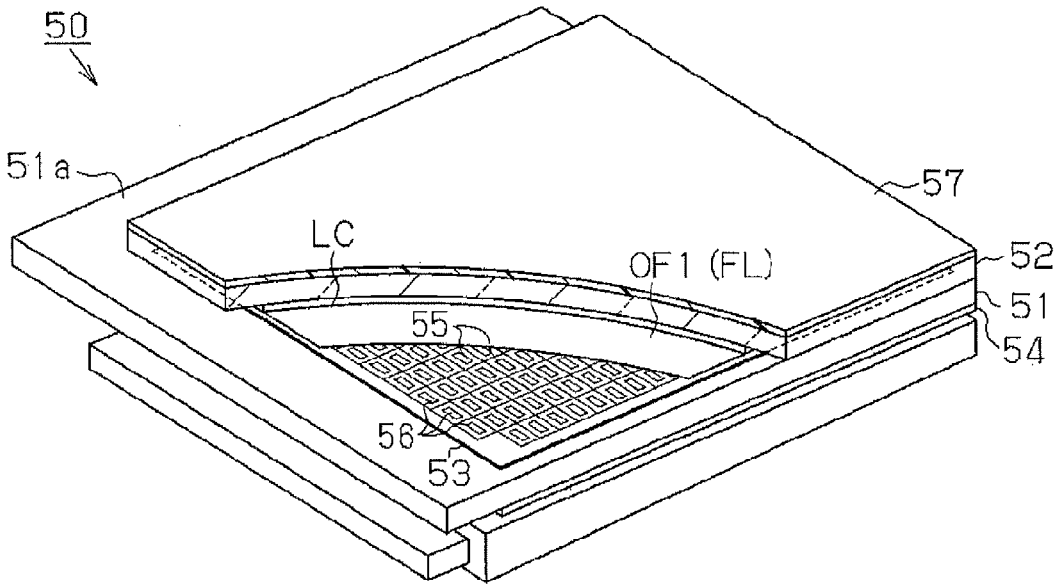
FIG. 11 is a perspective view of a liquid crystal display according to a fourth embodiment of the invention.
Figure 12:
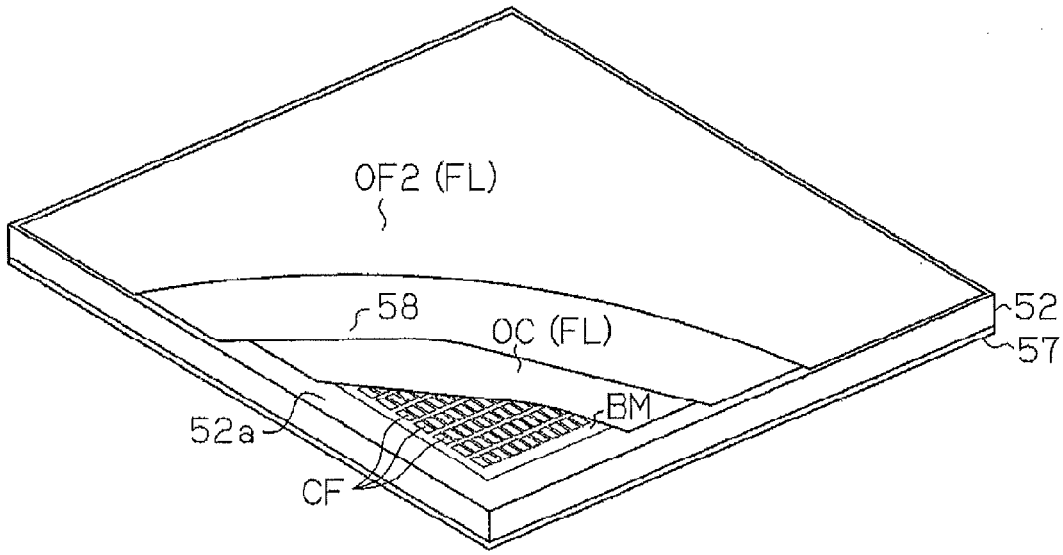
FIG. 12 is a perspective view of an opposing substrate included in the liquid crystal display.

Next, a liquid crystal display according to a fourth embodiment of the invention will be described with reference to FIGS. 11 and 12. FIG. 11 is a perspective view of the liquid crystal display as an electro-optical device, and FIG. 12 is a perspective view of an opposing substrate 52 included in the display.

In FIG. 11, a liquid crystal display 50 includes an element substrate 51 and the opposing substrate 52, which are opposed to each other. The substrates 51 and 52 are bonded together by a sealant 53 having a quadrangular frame-like shape, and liquid crystal (LC) is sealed in a gap therebetween.

On a lower surface of the element substrate 51 is bonded an optical substrate 54 such as a polarizing plate or a phase difference plate. The optical substrate 54 has a transmission axis in a predetermined direction to enable light from a backlight to be transmitted therethrough to the liquid crystal LC.

On an upper surface of the element substrate 51 (hereinafter referred to simply as an "element-formed surface 51*a*"), a plurality of element regions 55 are formed to be partitioned. Each of the element regions 55 includes a switching element (not shown) such as a thin film transistor (TFT) and an optically transparent pixel electrode 56.

On an upper side of the pixel electrodes 56, an oriented film OF1 is laminated entirely over the element-formed surface 51*a*. The oriented film OF1 is a thin film made of a high polymer (e.g. polyimide) having molecular orientation properties and determines the orientation direction of the liquid crystal LC molecules near the pixel electrode 56 corresponding thereto. The oriented film OF1 is formed as follows. The ink Ik including an oriented-film material (e.g. an orientational high polymer such as polyimide) dispersed therein is supplied into the liquid droplet discharging apparatus 10 to be discharged on an entire upper side of the element regions 55. Then, the fluid layer FL made of the liquid droplets D landed thereon is dried, so as to form the oriented film.

FIG. 12 is a perspective view of the opposing substrate 52 as it appears when a side thereof facing the element substrate 51 is positioned upward. In FIG. 12, a polarizing plate 57 is disposed on a lower surface of the opposing substrate 52 (an upper surface of thereof in FIG. 11). The polarizing plate 57 has a transmission axis in a predetermined direction to transmit light from the liquid crystal LC therethrough. Additionally, a black matrix BM is formed on an upper surface of the opposing substrate 52 (a lower surface thereof in FIG. 11, which is hereinafter referred to simply as a "filter-formed surface 52*a*"). The black matrix BM is a thin film made of a light-shielding material that shields light emitted from the liquid crystal LC. The matrix is formed into a lattice that surrounds regions facing the pixel electrodes 56. On the filter-formed surface 52*a*, color filters CF are formed in the regions surrounded by the black matrix BM. The color filters CF transmit light having a specific wavelength among light from the liquid crystal LC to convert the light therefrom into colored light and output it.

On upper sides of the black matrix BM and the color filters CF is laminated a common overcoating layer OC. The overcoating layer OC is a thin film made of an optically transparent resin that transmits light from the liquid crystal LC therethrough. The layer OC flattens the entire surface of the opposing substrate 52. It is formed as follows: The ink Ik including an optically transparent resin dispersed therein is supplied into the liquid droplet discharging apparatus 10 to be discharged on the entire surface of the opposing substrate 52. Then, the fluid layer FL made of the liquid droplets D landed thereon is dried, so as to obtain the overcoating layer OC.

On an upper side of the overcoating layer OC is laminated an optically transparent opposing electrode 58. When a predetermined common potential is applied to the opposing electrode 58, a potential difference is formed between each pixel electrode 56 and the opposing electrode 58, thereby modulating the molecular orientation of liquid crystal LC corresponding to each pixel electrode. In this manner, the polarization of light emitted from the optical substrate 54 is modulated in each of the element regions 55.

An oriented film OF2 is laminated on an upper side of the opposing electrode 58. Like the oriented film OF1, the film OF2 is made of a high polymer (e.g. polyimide) having molecular orientation properties and determines the molecular orientation of the liquid crystal LC therenear. In order to obtain the oriented film OF2, the ink Ik including a high polymer with the molecular orientation properties dispersed therein is supplied into the liquid droplet discharging apparatus 10 to be discharged on an entire surface of the opposing electrode 58. Then, the fluid layer FL made of the liquid droplets D landed thereon is dried to obtain the film.

As a result, the thickness uniformities of the oriented films OF1, OF2, and the overcoating layer OC can be improved, thereby improving the productivity of the liquid crystal display 50.

Meanwhile, the embodiments described above may be modified as follows:

In the first embodiment, every second former selected nozzle NFs in the sub-scanning direction is selected. Instead, for example, every third or more former nozzle NF in the sub-scanning direction may be selected as the former selected nozzle NFs. Alternatively, the former selected nozzle NFs may be nonperiodically selected.

Additionally, in the second embodiment, at every main discharging pitch Px in the main scanning direction, the former selected nozzles NFs and the latter selected nozzles NLs are alternately selected. Instead, for example, the former selected nozzles NFs may be selected at every integral multiple of the main discharging pitch Px in the main scanning direction. Alternatively, the former and the latter selected nozzles NFs and NLs may be nonperiodically and alternately selected.

Furthermore, in the third embodiment, by using the former and the latter selected nozzles NFs and NLs continuing in the sub-scanning direction, the boundary between the former and the latter fluid layers FLF and FLL is drawn in the saw-toothed shape in the main scanning direction. Alternatively, for example, as shown in FIG. 13, the boundary between the former selected droplets DF discharged on the left of the overlapping route RO and the latter selected droplets DL discharged on the right thereof may be formed into the saw-toothed shape continuing in the main-scanning direction, where each sawtooth may be formed by comb teeth extended in the sub-scanning direction.

In the above formation, the formation direction of the minute streak variation on the overlapping route RO is dispersed in multiple directions including the sub-scanning direction. Accordingly, the fluid layer LF formed on the overlapping route RO enables the boundary between the fluid layers FLF and FLL to be made more continuous. In this case, the controlling device 30 generates dotted pattern data corresponding to the dotted pattern in FIG. 13 and the serial pattern data SI corresponding to the data to allow the head driving circuit 40 to selectively discharge the former droplets DF and the latter droplets DL.

Figure 13:
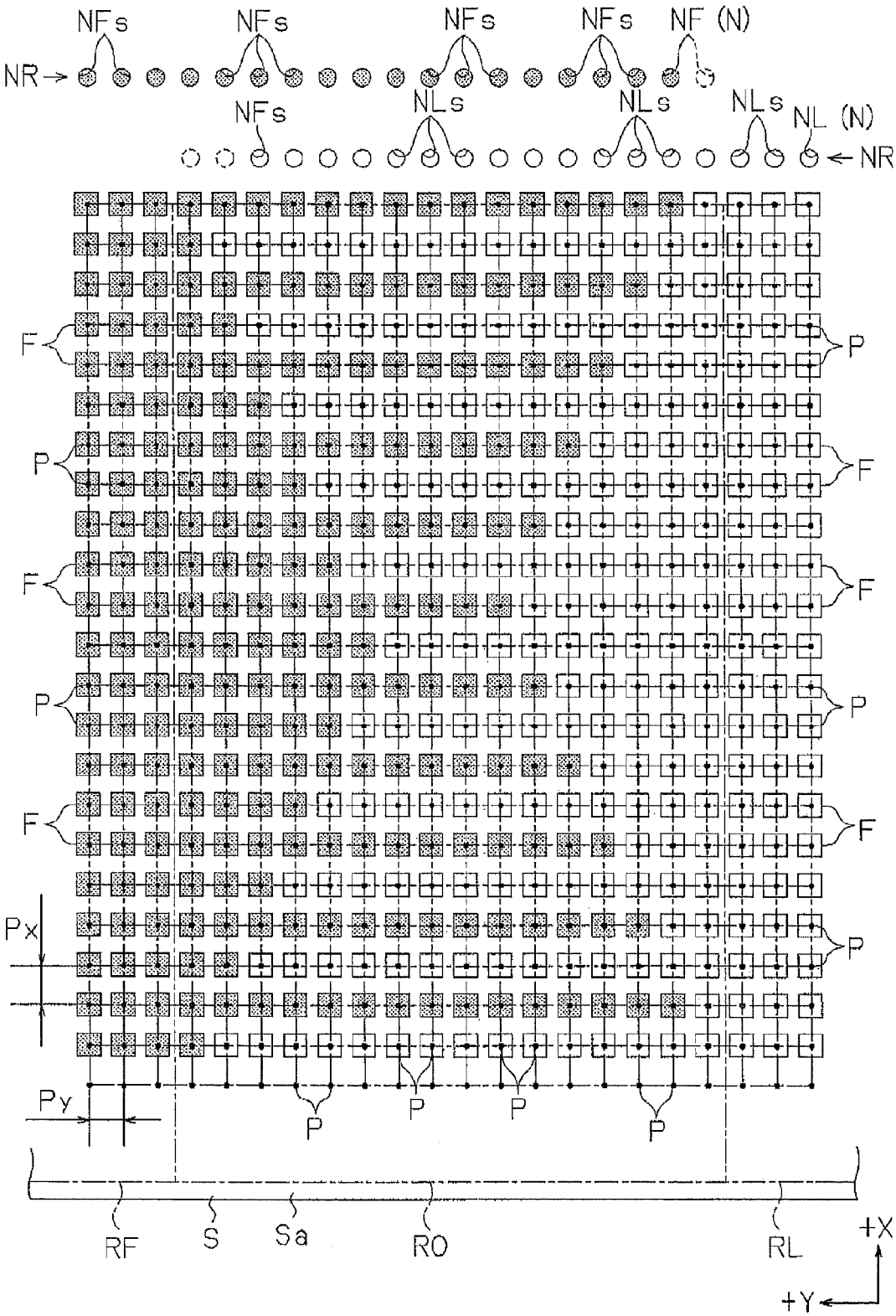
FIG. 13 is a schematic plan view showing a positional relationship between discharging positions and nozzles in the discharging apparatus according to a modification.
Figure 14:
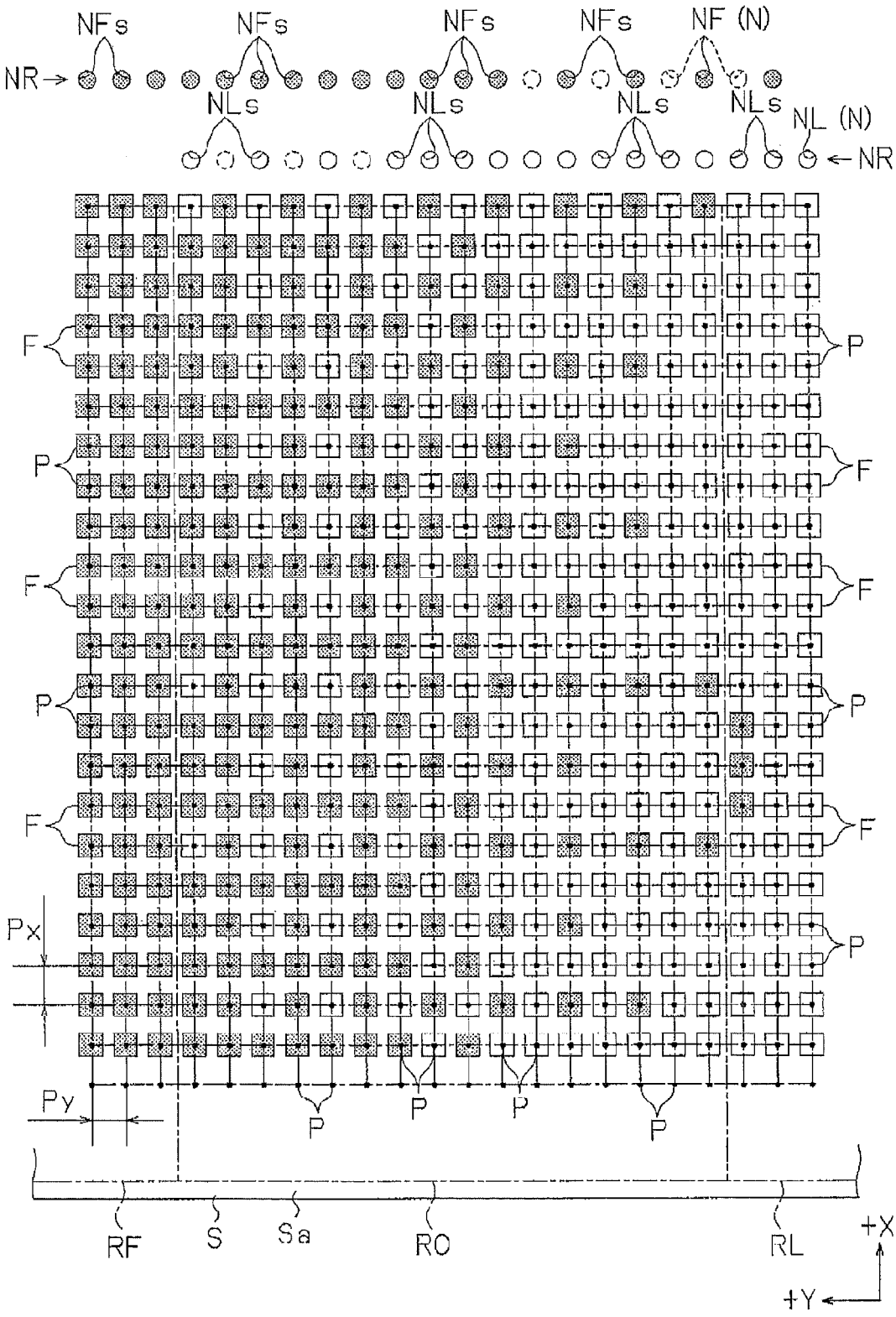
FIG. 14 is a schematic plan view showing a positional relationship between discharging positions and nozzles in the discharging apparatus according to another modification.

Moreover, as shown in FIG. 14, each comb tooth in FIG. 13 may be split by vertical stripes as shown in FIG. 6.

In the above formation, the formation direction of the streak variation on the overlapping route RO is dispersed in multiple directions including the main scanning direction and the sub-scanning direction. Consequently, the fluid layer FL formed on the overlapping route RO enables the boundary between the former fluid layer FLF and the latter fluid layer FLL to be made more continuous. Thereby, the streak variation therebetween can be more surely eliminated. In this case, the controlling device 30 generates dotted pattern data corresponding to the dotted pattern in FIG. 14 and the serial pattern data SI corresponding to the data to allow the head driving circuit 40 to selectively discharge the former and the latter droplets DF and DL.

In the embodiments, the controller 32 generates the dotted pattern data using the drawing data Ip. Alternatively, for example, the input/output device 37 may generate the dotted pattern data using the drawing data Ip to input the data to the controlling device 30.

In the embodiments, the piezoelectric elements PZ act as the actuators discharging the droplets D. Alternatively, a resistance heating element may be used as the actuator. Any element can be used that responds to a predetermined driving waveform signal COM to discharge the droplet D having an amount based on the waveform signal.

In the embodiments, the discharging head 16 includes only the single row of the 180 nozzles N. Alternatively, the head 16 may include two or more rows of the 180 nozzles N, or the number of nozzles included in the nozzle row NR may be more than 180.

In the embodiments, the electrooptical device is applied to the liquid crystal display 50 in which the oriented films OF1, OF2, and the overcoating layer OC are produced using the droplets D. Other than this, for example, the droplets D may be used to produce the color filters CF and the opposing electrode 58. Furthermore, the electrooptical device of the embodiment may be applied to an electroluminescence display, in which a light-emitting element may be produced using the droplets D that includes a material forming the element.

The entire disclosure of Japanese Patent Application No. 2007-74132, filed Mar. 22, 2007 is expressly incorporated by reference herein.

What is claimed is:

1. A pattern forming method for forming a pattern on a substrate by relatively moving a plurality of nozzle groups and the substrate in a main-scanning direction a plurality of times, each of the plurality of nozzle groups including a plurality of nozzles arranged in a first direction, the method comprising:

(i) relatively moving each of the nozzle groups and the substrate in a sub-scanning direction such that a rear end of a former nozzle group overlaps a front end of a latter nozzle group when viewed from the main-scanning direction after every relative movement between the nozzle group and the substrate in the main-scanning direction;

(ii) selecting a plurality of former nozzles among the nozzles of the former group that overlap those of the latter group to allow the selected former nozzles to discharge liquid droplets upon the relative movement between the former nozzle group and the substrate in the main-scanning direction;

(iii) selecting a plurality of latter nozzles positioned between the selected former nozzles among the nozzles of the latter group that overlap those of the former group to allow the selected latter nozzles to discharge liquid droplets upon the relative movement between the latter nozzle group and the substrate in the main-scanning direction; and (iv) discharging droplets to the substrate to form the pattern on the substrate, the pattern including an overlapped area, the overlapped area including a first portion and a second portion that are adjacent to each other, the first portion formed from a plurality of first lines and a plurality of second lines, the second portion formed from a plurality of third lines and a plurality of fourth lines, the first, second, third, and fourth lines each extending in the main-scanning direction, the first lines formed by discharging droplets from each of the selected former nozzles and the selected latter nozzles, the second lines formed entirely by the selected former nozzles, the third lines formed by discharging droplets from each of the selected former nozzles and the selected latter nozzles, the fourth lines formed entirely by the selected latter nozzles, the first and second lines alternating across the entire first portion of the overlapped area, the third and fourth lines alternating across the entire second portion of the overlapped area.

2. The pattern forming method according to claim 1, wherein, upon the relative movement between the former nozzle group and the substrate in the main-scanning direction, the plurality of former nozzles are selected at every predetermined interval in the first direction among the nozzles of the former group that overlap those of the latter group to allow the selected former nozzles to discharge the liquid droplets.

3. The pattern forming method according to claim 1, wherein, upon the relative movement between the former nozzle group and the substrate in the main-scanning direction, the plurality of former nozzles are selected among the nozzles of the former group that overlap those of the latter group to allow the selected former nozzles to discharge former droplets, whereas upon the relative movement between the latter nozzle group and the substrate in the main-scanning direction, a plurality of latter nozzles corresponding to the selected former nozzles are selected among the nozzles of the latter group that overlap those of the former group to allow the corresponding latter nozzles to discharge latter liquid droplets between the former droplets landed in the main-scanning direction.

4. The pattern forming method according to claim 1, wherein, upon the relative movement between the former nozzle group and the substrate in the main-scanning direction, the position of a former nozzle nearest to the latter nozzle group among the selected former nozzles is displaced in the first direction.

5. A pattern forming method for forming a pattern on a substrate by relatively moving a plurality of nozzle groups and the substrate in a main-scanning direction a plurality of times, each of the plurality of nozzle groups including a plurality of nozzles arranged in a first direction, the method comprising:

(i) relatively moving each of the nozzle groups and the substrate in a sub-scanning direction such that a rear end of a former nozzle group overlaps a front end of a latter nozzle group when viewed from the main-scanning direction after every relative movement between the nozzle group and the substrate in the main-scanning direction;

(ii) selecting a plurality of former nozzles among the nozzles of the former group that overlap those of the latter group to allow the selected former nozzles to discharge former liquid droplets upon the relative movement between the former nozzle group and the substrate in the main-scanning direction;

(iii) selecting a plurality of latter nozzles corresponding to the selected former nozzles among the nozzles of the latter group that overlap those of the former group to allow the corresponding latter nozzles to discharge latter liquid droplets between the former droplets landed in the main-scanning direction upon the relative movement between the latter nozzle group and the substrate in the main-scanning direction; and (iv) discharging droplets to the substrate to form the pattern on the substrate, the pattern including an overlapped area, the overlapped area including a first portion and a second portion that are adjacent to each other, the first portion formed from a plurality of first lines and a plurality of second lines, the second portion formed from a plurality of third lines and a plurality of fourth lines, the first, second, third, and fourth lines each extending in the main-scanning direction, the first lines formed by discharging droplets from each of the selected former nozzles and the selected latter nozzles, the second lines formed entirely by the selected former nozzles, the third lines formed by discharging droplets from each of the selected former nozzles and the selected latter nozzles, the fourth lines formed entirely by the selected latter nozzles, the first and second lines alternating across the entire first portion of the overlapped area, the third and fourth lines alternating across the entire second portion of the overlapped area.

6. The pattern forming method according to claim 5, wherein, upon the relative movement between the former nozzle group and the substrate in the main-scanning direction, the plurality of former nozzles are selected among the nozzles of the former group that overlap those of the latter group to allow the selected former nozzles to discharge the former droplets at predetermined intervals in the main-scanning direction.

7. The pattern forming method according to claim 5, wherein, upon the relative movement between the former nozzle group and the substrate in the main-scanning direction, a plurality of former nozzles continuing in the first direction are selected among the nozzles of the former group that overlap those of the latter group to allow the selected former nozzles to discharge the former droplets at predetermined intervals in the main-scanning direction.

8. The pattern forming method according to claim 5, wherein, upon the relative movement between the former nozzle group and the substrate in the main-scanning direction, the position of a former nozzle nearest to the latter nozzle group among the selected former nozzles is displaced in the first direction.

9. A liquid droplet discharging apparatus, comprising:

a plurality of nozzle groups each including a plurality of nozzles arranged in a first direction;

a moving unit that relatively moves each of the nozzle groups and the substrate in a main-scanning direction and a sub-scanning direction; and a controlling unit that drives the moving unit to relatively move the nozzle groups and the substrate a plurality of times in the main-scanning direction, wherein each of the nozzle groups and the substrate is relatively moved in the sub-scanning direction such that a rear end of a former nozzle group overlaps a front end of a latter nozzle group when viewed from the main-scanning direction after every relative movement between the nozzle group and the substrate in the main-scanning direction, the controlling unit generating former selection data that selects a plurality of former nozzles among the nozzles of the former group that overlap those of the latter group to allow the selected former nozzles to discharge liquid droplets based on the former selection data, as well as generating latter selection data that selects a plurality of latter nozzles positioned between the selected former nozzles among the nozzles of the latter group that overlap those of the former group to allow the selected latter nozzles to discharge liquid droplets based on the latter selection data, the former and latter selection data operable to cause the selected former and latter nozzles to discharge droplets to the substrate to form a pattern on the substrate, the pattern including an overlapped area, the overlapped area including a first portion and a second portion that are adjacent to each other, the first portion formed from a plurality of first lines and a plurality of second lines, the second portion formed from a plurality of third lines and a plurality of fourth lines, the first, second, third, and fourth lines each extending in the main-scanning direction, the first lines formed by discharging droplets from each of the selected former nozzles and the selected latter nozzles, the second lines formed entirely by the selected former nozzles, the third lines formed by discharging droplets from each of the selected former nozzles and the selected latter nozzles, the fourth lines formed entirely by the selected latter nozzles, the first and second lines alternating across the entire first portion of the overlapped area, the third and fourth lines alternating across the entire second portion of the overlapped area.

10. An electrooptical device comprising a substrate and an oriented film formed on a side surface thereof, the oriented film being formed by the liquid droplet discharging apparatus according to claim 9.

11. A liquid droplet discharging apparatus, comprising:

a plurality of nozzle groups each including a plurality of nozzles arranged in a first direction;

a moving unit that relatively moves each of the nozzle groups and the substrate in a main-scanning direction and a sub-scanning direction; and a controlling unit that drives the moving unit to relatively move the nozzle groups and the substrate a plurality of times in the main-scanning direction, wherein each of the nozzle groups and the substrate are relatively moved in the sub-scanning direction such that a rear end of a former nozzle group overlaps a front end of a latter nozzle group when viewed from the main-scanning direction after every relative movement between the nozzle group and the substrate in the main-scanning direction, the controlling unit generating former selection data that selects a plurality of former nozzles among the nozzles of the former group that overlap those of the latter group to allow the selected former nozzles to discharge former liquid droplets based on the former selection data, as well as generating latter selection data that selects a plurality of latter nozzles corresponding to the selected former nozzles among the nozzles of the latter group that overlap those of the former group when the latter group is opposed to positions between the former liquid droplets to allow the selected latter nozzles to discharge latter liquid droplets between the former liquid droplets based on the latter selection data, the former and latter selection data operable to cause the selected former and latter nozzles to discharge droplets to the substrate to form a pattern on the substrate, the pattern including an overlapped area, the overlapped area including a first portion and a second portion that are adjacent to each other, the first portion formed from a plurality of first lines and a plurality of second lines, the second portion formed from a plurality of third lines and a plurality of fourth lines, the first, second, third, and fourth lines each extending in the main-scanning direction, the first lines formed by discharging droplets from each of the selected former nozzles and the selected latter nozzles, the second lines formed entirely by the selected former nozzles, the third lines formed by discharging droplets from each of the selected former nozzles and the selected latter nozzles, the fourth lines formed entirely by the selected latter nozzles, the first and second lines alternating across the entire first portion of the overlapped area, the third and fourth lines alternating across the entire second portion of the overlapped area.

* * * * *